US009605636B2

(12) United States Patent
Romeo et al.

(10) Patent No.: US 9,605,636 B2
(45) Date of Patent: Mar. 28, 2017

(54) FUEL INJECTOR AND FUEL-INJECTION SYSTEM

(71) Applicant: Continental Automotive GmbH, Hannover (DE)

(72) Inventors: Ileana Romeo, Grossetto (IT); Matteo Soriani, Leghorn (IT); Francesco Lenzi, Leghorn (IT)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 310 days.

(21) Appl. No.: 13/948,666

(22) Filed: Jul. 23, 2013

(65) Prior Publication Data

US 2014/0020657 A1 Jan. 23, 2014

(30) Foreign Application Priority Data

Jul. 23, 2012 (EP) ..... 12177458

(51) Int. Cl.
*F02M 61/14* (2006.01)
*F02M 61/16* (2006.01)

(52) U.S. Cl.
CPC ..... *F02M 61/14* (2013.01); *F02M 61/168* (2013.01); *F02M 2200/858* (2013.01)

(58) Field of Classification Search
CPC .. F02M 61/14; F02M 61/168; F02M 2200/09; F02M 55/004; F02M 2200/9007; F02M 2200/9015; F02M 2200/9053; F02M 2200/9092; F02B 51/04
USPC ..... 123/446, 470; 239/585.1
See application file for complete search history.

(56) References Cited

U.S. PATENT DOCUMENTS 4,637,554 A * 1/1987 Takeda ..... F02M 51/065 239/585.3
4,796,354 A * 1/1989 Yokoyama ..... B29C 45/14491 123/146.5 A
4,887,572 A * 12/1989 Kodama ..... B22F 7/06 123/146.5 A (Continued)

FOREIGN PATENT DOCUMENTS

CN 2416241 Y 1/2001 ..... F02M 27/04
CN 101275528 A 10/2008 ..... F02M 59/36

(Continued)

OTHER PUBLICATIONS

European Search Report, Application No. 12177458.2, 4 pages, Nov. 16, 2012.

(Continued)

*Primary Examiner* — Marguerite McMahon
*Assistant Examiner* — James Kim
(74) *Attorney, Agent, or Firm* — Slayden Grubert Beard PLLC

(57) ABSTRACT

A fuel injector may include a central longitudinal axis and may be arranged in a cylinder head of a combustion engine. The fuel injector has an injector body and an adjustment device, the adjustment device including a ring element configured to be arranged in a recess of a cylinder head between the injector body and the cylinder head to align the fuel injector relative to the recess in radial direction. The ring element comprises a magnetic material. A fuel-injection system is also disclosed that includes a cylinder head of an internal combustion engine and a fuel injector as disclosed above.

19 Claims, 2 Drawing Sheets

(56) References Cited

U.S. PATENT DOCUMENTS 5,967,110 A * 10/1999 Tsutsui ..... B22F 3/1003 123/195 HC
6,069,103 A * 5/2000 Kwon ..... C04B 35/486 501/103
7,219,652 B2 * 5/2007 Ino ..... F02B 27/02 123/336
7,444,992 B2 * 11/2008 Ricci ..... F02M 61/14 123/470
7,823,565 B2 * 11/2010 Chern ..... F02M 55/004 123/192.1
7,845,617 B2 12/2010 Cobianchi et al. ..... 251/129.15
8,516,996 B2 * 8/2013 Solferino ..... F02M 61/14 123/470
2002/0124405 A1 * 9/2002 Hasegawa ..... F02M 51/0682 29/890.12
2008/0191064 A1 * 8/2008 Sawaki ..... F02M 47/027 239/533.11
2008/0314366 A1 * 12/2008 Welzmueller ..... F02M 61/14 123/470
2009/0050113 A1 * 2/2009 Liskow ..... F02M 61/14 123/470
2009/0071445 A1 * 3/2009 Mueller ..... F02M 61/14 123/470
2009/0235898 A1 * 9/2009 Short ..... F02M 53/046 123/470
2011/0000464 A1 * 1/2011 Kannan ..... F02M 55/004 123/470
2014/0123952 A1 * 5/2014 Yasuda ..... F02M 61/14 123/470
2015/0059703 A1 * 3/2015 Kochanowski ..... F02M 61/14 123/470

FOREIGN PATENT DOCUMENTS

EP 2251541 A1 11/2010 ..... F02M 61/14
JP 2006022654 A 1/2006 ..... F02M 61/14

OTHER PUBLICATIONS

Chinese Office Action, Application No. 201310310338.2, 10 pages, May 14, 2015.

* cited by examiner

FUEL INJECTOR AND FUEL-INJECTION SYSTEM

CROSS-REFERENCE TO RELATED APPLICATIONS

This application claims priority to EP Patent Application No. 12177458 filed Jul. 23, 2012. The contents of which are incorporated herein by reference in their entirety.

TECHNICAL FIELD

This disclosure relates to a fuel injector and a fuel-injection system.

BACKGROUND

Fuel injectors are in wide spread use, in particular for internal combustion engines where they may be arranged in order to dose fuel into an intake manifold of the internal combustion engine or directly into the combustion chamber of a cylinder of the internal combustion engine. Fuel can be supplied to the internal combustion engine by the fuel injectors of the fuel-injection system.

The fuel injectors can be coupled to the cylinder head of the internal combustion engine in different manners. The coupling of the fuel injectors to the cylinder heads needs to be very precise to obtain a correct injection angle.

SUMMARY

One embodiment provides a fuel injector including a central longitudinal axis and being operable to be arranged in a cylinder head of a combustion engine, the fuel injector having an injector body and an adjustment device, the adjustment device comprising a ring element being designed to be arranged in a recess of the cylinder head between the injector body and the cylinder head to align the fuel injector relative to the recess, wherein the ring element comprises a magnetic material.

According to a further embodiment, the ring element is a composite comprising at least a first material being magnetic and a second material being nonmagnetic.

According to a further embodiment, at least one of the first material and the second material of the ring element is a sintered material.

According to a further embodiment, the ring element comprises a magnetic powder.

According to a further embodiment, the magnetic powder comprises a ferrite or a rare earth metal.

According to a further embodiment, the ring element is of a material comprising a stainless steel.

According to a further embodiment, the ring element is of a material comprising a plastic.

According to a further embodiment, the ring element is of a material comprising at least a polyphenylene sulfide or a polyethylene terephthalate.

According to a further embodiment, the magnetic material is a ferromagnetic material.

Another embodiment provides a fuel-injection system with a cylinder head of an internal combustion engine and a fuel injector as disclosed above, wherein the fuel injector is arranged in a recess of the cylinder head.

According to a further embodiment, the ring element abuts the injector body and a surface of the recess.

BRIEF DESCRIPTION OF THE DRAWINGS

Exemplary embodiments are explained below with reference to the drawings, in which.

DETAILED DESCRIPTION

Figure 1:
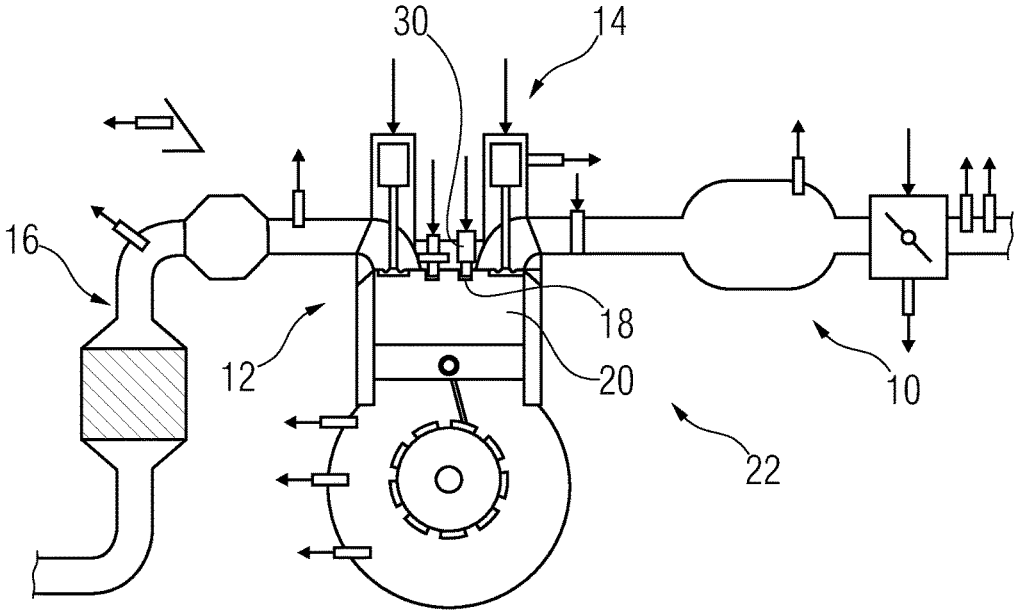
FIG. 1 an internal combustion engine in a schematic view.

Some embodiments provide a fuel injector for a cylinder head of a combustion engine which is simple to be manufactured and which facilitates a reliable and precise coupling between the fuel injector and the cylinder head of the combustion engine.

Other embodiments provide a fuel-injection system that ensures a precise dosing of fuel.

One embodiment provides a fuel injector including a central longitudinal axis. Expediently, the fuel injector is operable to be arranged in a cylinder head of a combustion engine. The fuel injector has an injector body and an adjustment device. The adjustment device comprises a ring element. The ring element is in particular designed to be arranged in a recess of a cylinder head between the injector body and the cylinder head to align the fuel injector relative to the recess. The ring element comprises a magnetic material. The magnetic material may be a ferromagnetic material. The ring, by means of the magnetic material, in particular represents a permanent magnet.

This has the advantage that the adjustment device with the ring element comprising the magnetic material may be operated to fix the fuel injector in the cylinder head of the combustion engine without the use of additional components. Therefore, the number of components for the fuel injector may be kept small. Consequently, a low cost solution for the fuel injector may be obtained. Furthermore, an easy and fast assembly and disassembly of the fuel injector may be possible.

In one embodiment the ring element is a composite comprising at least a first material being magnetic and a second material being nonmagnetic. In this way, good magnetic properties as well as good mechanical properties of the ring element may be obtained. For example, the first and second materials maybe mixed with each other or the first material may be dispersed in the second material or vice versa. The nonmagnetic material is in particular negligibly affected by magnetic fields.

In a further embodiment at least one of the first material and the second material of the ring element is a sintered material. This has the advantage that the ring element may be produced with little costs.

In a further embodiment the ring element comprises a magnetic powder. This has the advantage that the powder with magnetic characteristics may be embedded into a composite which has good mechanical properties.

In a further embodiment the magnetic powder is a ferrite or a rare earth metal or comprises a rare earth metal.

In a further embodiment the ring element is of a material comprising a stainless steel. This has the advantage that good mechanical properties of the ring element may be obtained.

In a further embodiment the ring element is of a material comprising a plastic. By this a good contact between the ring element and the cylinder head is possible. Furthermore, little adhesion between the ring element and the cylinder head during lifetime may be obtained. Consequently, simple service operations are possible. Additionally, due to the ability of the plastic to absorb shocks and vibrations a low noise due to a contact between the fuel injector and the cylinder head may be obtained. Furthermore, differently coloured plastics may be used in order to identify different applications.

In a further embodiment the ring element is of a material comprising at least a polyphenylene sulfide or a polyethylene terephthalate. This has the advantage that polyphenylene sulfide and polyethylene terephthalate are hard and robust plastics.

Another embodiment provides a fuel injector having a central longitudinal axis is specified, the fuel injector having an injector body and an adjustment device. The adjustment device comprises a ring element which ring element comprises a magnetic material. The fuel injector, the injection body, the adjustment device, the ring element and the magnetic material maybe embodied in accordance with the above embodiments.

Another embodiment provides a fuel-injection system with a cylinder head of an internal combustion engine and a fuel injector as disclosed herein. The fuel injector is arranged in a recess of the cylinder head. In one expedient embodiment, the ring element abuts the injector body and the cylinder head.

FIG. 1 shows an internal combustion engine 22, with an intake air tract 10, a motor block 12, a cylinder head 14 and an exhaust gas tract 16. In the motor block 12 a combustion chamber 20 is arranged.

The cylinder head 14 comprises one or more recesses 15 in which at least one fuel injector 18 is arranged. The fuel injector 18 is at least partially in engagement with the recess 15. An adjustment device 30 is arranged in the recess 15 and enables the adjustment of the fuel injector 18 relative to the cylinder head 14 of the combustion engine 22.

Figure 2:
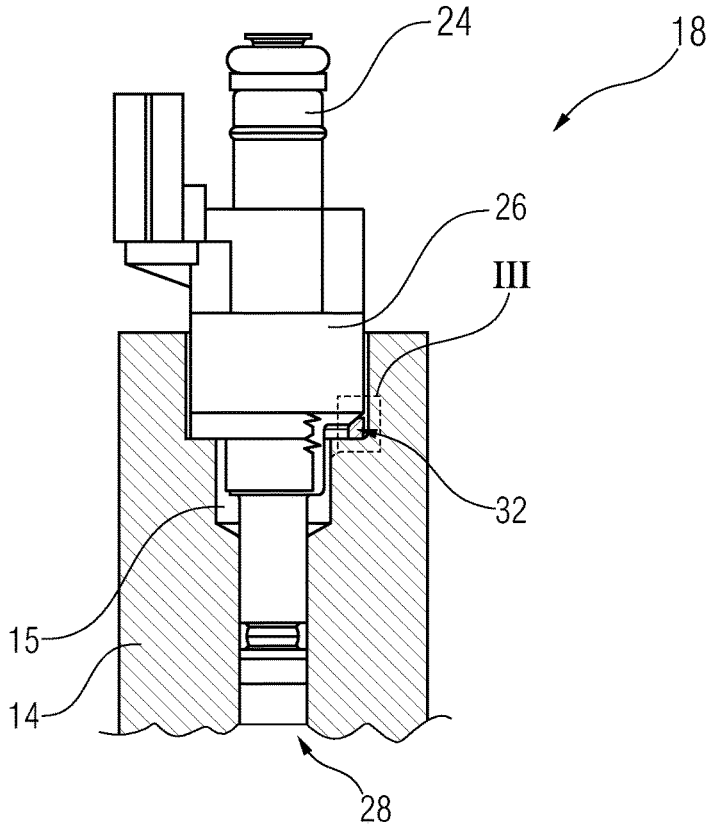
FIG. 2 a fuel injector and a cylinder head in a schematic view.

FIG. 2 shows the fuel injector 18 with an injector coupling portion 24. The injector coupling portion 24 may be coupled to a high-pressure fuel chamber of the internal combustion engine 22, the fuel is stored under high pressure, for example, under the pressure of about 200 bar in the case of a gasoline engine or of more than 2,000 bar in the case of a diesel engine.

The fuel injector 18 comprises an injector body 26 with a central longitudinal axis L and a not shown cavity which is axially led through the injector body 26. The fuel injector 18 further comprises a not shown valve needle taken in the cavity of the injector body 26. On a free end of the fuel injector 18 an injection nozzle 28 is formed which is closed or opened by an axial movement of the valve needle. In a closing position a fuel flow through the injection nozzle 28 is prevented. In an opening position fuel can flow through the injection nozzle 28 into the combustion chamber 20 of the internal combustion engine 22.

Figure 3:
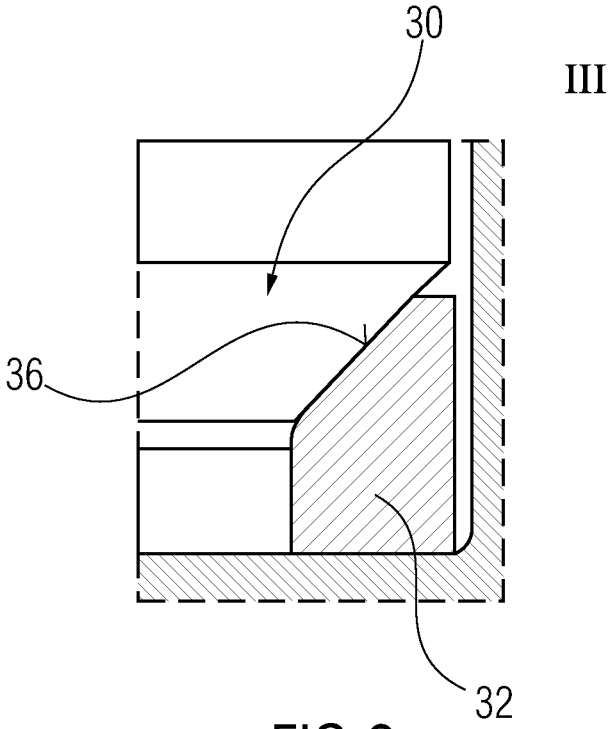
FIG. 3 a detail III of FIG. 2.
Figure 4:
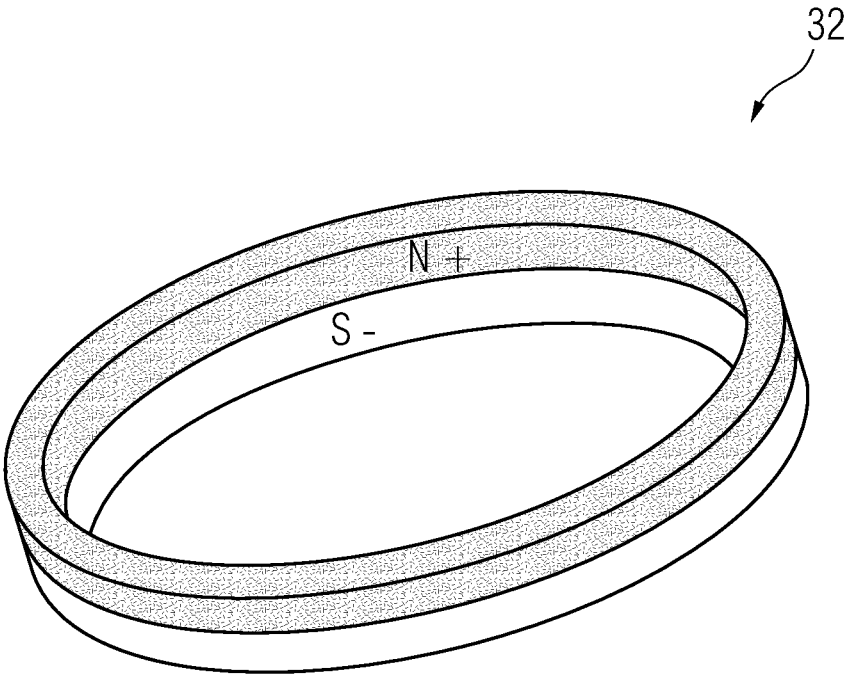
FIG. 4 a perspective view of a ring element.

The adjustment device 30 comprises a ring element 32 which is shown in FIGS. 2 to 4. The ring element 32 is arranged in the recess 15 between the injector body 26 and the cylinder head 14. The ring element 32 has the function of a washer. In particular, it abuts the injector body 26 and also abuts a surface of the recess 15 of the cylinder head 14.

The ring element 32 has a material having magnetic characteristics For example, it is a permanent magnet.

The ring element 32 may be a composite comprising different materials. A first material has magnetic characteristics. A second material may be nonmagnetic.

The ring element 32 may comprise a plastic material. In particular, the ring element 32 comprises a polymeric binder.

Ring elements 32 comprising a plastic may enable a good contact between the ring element 32 and the cylinder head 14. Furthermore, only little adhesion between the ring element 32 and the cylinder head 14 during the lifetime of the fuel injector 18 may be obtained. Therefore, it is possible that the necessary services as for example a disassembling of the fuel injector 18 from the cylinder head 14 may be carried out very simple. Furthermore, plastics may have a good ability to absorb shocks and vibrations. Therefore, ring elements 32 comprising plastics may achieve a low noise emission in a contact zone between the fuel injector 18 and the cylinder head 14. The ring element 32 may be formed from a material comprising a polyphenylene sulfide (PPS). PPS is a very hard and robust plastic. In further embodiments, the ring element 32 is of a material which comprises a polyethylene terephthalate (PET).

In an alternative embodiment, the ring element 32 is of a material which comprises a stainless steel. This makes it possible that the ring element 32 has very good mechanical properties. In particular, a high mechanical stability of the ring element 32 may be obtained.

In one embodiment, the ring element 32 is of a material comprising a powder with magnetic characteristics. The powder with magnetic characteristics may be embedded into the second material which is nonmagnetic. In particular, the powder with magnetic characteristics may be embedded into materials comprising stainless steel and/or plastics. In particular, the powder with magnetic characteristics maybe incorporated into stainless steel being sintered to shape the ring element 32. The powder with magnetic characteristics comprises a ferrite or a rare earth metal. A ferrite is in particular a—e.g., ceramic—material having iron(III) oxide as principal constituent, such as hematite ($Fe_2O_3$) or magnetite ($Fe_3O_4$). A material with magnetic characteristics comprising a rare earth metal may, for example, be a compound of a rare earth element and a transition metal, such as $Nd_2Fe_{14}B$, $SmCo_5$ or Sm (Co, Fe, Cu, Zr)$_7$, and may be in particular ferromagnetic.

As shown in FIG. 3, the ring element 32 may have a spherical surface 36. The spherical surface 36 faces the central longitudinal axis L. The spherical surface 36 arranged circumferentially over the ring element 32. Due to the spherical surface 36 the fuel injector 18 can be adjusted relative to the recess 15. The spherical surface 36 of the ring element 32 acts as a centering unit for the fuel injector 18 in the recess 15 due to the contact with the conical surface of the injector body 26.

The construction of the adjustment device 30 with the ring element 32 having a material with magnetic characteristics allows an exact alignment of the fuel injector 18 relative to the cylinder head 14. Consequently, the injection process in the combustion chamber 20 of the internal combustion engine 22 may be carried out with a high precision in particular in view of the injection angle and the position of the injection point.

What is claimed is:

1. Fuel injector assembly comprising:

a fuel injector having a central longitudinal axis and configured for arrangement in a cylinder head of a combustion engine, the fuel injector comprising an injector body, and an adjustment device comprising a ring element configured for arrangement in a recess of the cylinder head between the fuel injector and the cylinder head to align the fuel injector relative to the recess, wherein the ring element comprises a permanent magnet material magnetically adhered to at least one of the cylinder head and the injector body when arranged in the recess to provide a mechanical coupling between the fuel injector body and the cylinder head without additional components for coupling.

2. Fuel injector in accordance with claim 1, wherein the ring element is a composite comprising at least a first permanent magnet material and a second non-magnetic material.

3. Fuel injector in accordance with claim 2, wherein at least one of the first material and the second material of the ring element is a sintered material.

4. Fuel injector in accordance with claim 1, wherein the ring element comprises a magnetic powder.

5. Fuel injector in accordance with claim 4, wherein the magnetic powder comprises a ferrite or a rare earth metal.

6. Fuel injector in accordance with claim 1, wherein the ring element comprises stainless steel.

7. Fuel injector in accordance with claim 1, wherein the ring element comprises plastic.

8. Fuel injector in accordance with claim 1, wherein the ring element comprises a polyphenylene sulfide or a polyethylene terephthalate.

9. Fuel injector in accordance with claim 1, wherein the permanent magnet material is a ferromagnetic material.

10. Fuel-injection system, comprising:

a cylinder head of an internal combustion engine, a fuel injector comprising=an injector body having a central longitudinal axis, and an adjustment device comprising a ring element arranged in a recess of the cylinder head between the fuel injector and the cylinder head to align the fuel injector relative to the recess of the cylinder head, wherein the ring element comprises a magnetic material that produces a sufficient magnetic field to provide adhesion between the ring element and at least one of the cylinder head and the injector body to provide a mechanical coupling between the fuel injector and the cylinder head without additional components for coupling.

11. Fuel-injection system according to claim 10, wherein the ring element abuts the injector body and a surface of the recess.

12. Fuel injector in accordance with claim 10, wherein the ring element is a composite comprising at least a first magnetic material and a second non- magnetic material.

13. Fuel injector in accordance with claim 12, wherein at least one of the first material and the second material of the ring element is a sintered material.

14. Fuel injector in accordance with claim 10, wherein the ring element comprises a magnetic powder.

15. Fuel injector in accordance with claim 14, wherein the magnetic powder comprises a ferrite or a rare earth metal.

16. Fuel injector in accordance with claim 10, wherein the ring element comprises stainless steel.

17. Fuel injector in accordance with claim 10, wherein the ring element comprises plastic.

18. Fuel injector in accordance with claim 10, wherein the ring element comprises a polyphenylene sulfide or a polyethylene terephthalate.

19. Fuel injector in accordance with claim 10, wherein the magnetic material is a ferromagnetic material.

* * * * *